United States Patent [19]

Brown, Jr.

[11] 4,011,975

[45] Mar. 15, 1977

[54] WEB HANDLING SYSTEM

[75] Inventor: Fred P. Brown, Jr., Centerville, Mass.

[73] Assignee: Packaging Industries, Inc., Hyannis, Mass.

[22] Filed: Sept. 8, 1975

[21] Appl. No.: 611,234

[52] U.S. Cl. ..... 226/2; 226/33; 226/109

[51] Int. Cl.[2] ..... B65H 25/24

[58] Field of Search ..... 226/2, 30, 33, 109

[56] References Cited

UNITED STATES PATENTS

| | | | |
|---|---|---|---|
| 2,850,091 | 9/1958 | Carter | 226/30 |
| 2,947,345 | 8/1960 | Schjeldahl | 226/109 |
| 3,797,720 | 3/1974 | Gaudion | 226/33 |
| 3,816,210 | 6/1974 | Aoko et al. | 226/2 |
| 3,848,528 | 11/1974 | Seedorf | 226/30 |

*Primary Examiner*—Robert W. Saifer
*Attorney, Agent, or Firm*—Brumbaugh, Graves, Donohue & Raymond

[57] ABSTRACT

A web handling system is described for incrementally feeding a web, and preferably multiple webs, to a processing station. Each web is advanced to the processing station by a pair of web-feeding rollers. One motor drives all of the web-feeding roller pairs through respective clutch-brakes connected to each roller pair. Each web has index marks imprinted along its length at intervals corresponding to intervals at which it is desired to precisely register the web with the processing station. A first detecting means disposed along one of the web paths (or similar detecting means along another web path) initially detects an index mark on the web travelling that path to provide a signal which decelerates the motor and thus slows all of the web-feeding rollers and the webs. Second index mark detecting means, one for each web path, then detect the index marks on the respective associated webs as they now more slowly advance towards the processing station. When actuated, each second index mark detecting means produces a signal which disengages the clutch and applies the brake of the clutch-brake associated with the same web to independently stop each web. The second index mark detecting means are positioned relative to the processing station such that the desired portion of each web is registered with the processing station when the second index mark detecting means causes its associated web to independently stop. Since the web-feeding rollers are slowed prior to stopping and since each web is independently indexed with the processing station, each web is precisely registered with the processing station.

12 Claims, 3 Drawing Figures

WEB HANDLING SYSTEM

BACKGROUND OF THE INVENTION

The present invention relates to a web handling system and, more particularly, to a system for incrementally moving webs of flexible, elastic sheet material to a processing station and precisely registering each web with the processing station.

In numerous applications, a web or continuous sheet of paper, film, plastic, or other material must be incrementally advanced to a processing station at which certain steps of manufacture or use are carried out with respect to the web while the web is stopped in registry with the processing station. Although it may be possible to perform these steps of manufacture or use upon the web while the web is actually moving through the processing station, many operations such as heat sealing, perforating, or cutting superimposed plastic webs require substantial time of engagement between sealing, perforating, or cutting apparatus and the webs relative to the high speeds at which it is economically desirable to advance the webs to the apparatus. To prevent one or more continuously advancing webs from being jammed and wrinkled or torn, the processing apparatus must be advanced with the web while it performs its function and then returned to an upstream portion of the advancing web for repeating its operation. This type of processing is often referred as "flying" and is known to be uneconomically expensive to implement and difficult to synchronize with the advancing web.

The difficulty of operating such flying apparatus is increased when a single processing apparatus is to operate on multiple webs because the advancing movement of each separately fed web must then also be synchronized with the other webs. Therefore, it is particularly desirable to incrementally advance separately fed webs to a processing station and then stop the webs in registry with the processing station during its operation.

Since webs are ordinarily obtained from a continuous supply such as a roll, the feeding of the web from the supply must be coordinated with the incremental stopping and starting of the web at the processing station. In a conventional installation, a pair of nip rollers engages the web adjacent the processing station. The rollers are driven to advance a desired length of web into the processing station and then stopped for the time necessary to complete the processing step in the station, the sequence being repeated for the length of the web. The incremental advance of the web presents a number of difficulties among which is the difficulty of accurately stopping and starting the unwinding of the web from a desirably large supply roll in increments and particularly short increments at which it may be desired to operate on the web in the processing station. This difficulty is accentuated when the web is both stretchable and fragile as, for example, thin webs of plastic used for making plastic bags which may be from 1.0 mil (about 0.003 cm.) to 10 mil (0.025 cm.) thick.

Presently known systems for such incremental web feeding suffer from several drawbacks which impose severe restrictions on their operation, particularly with respect to uniformity of increment lengths and speed. Conventionally, one pair of nip rollers is used to drive each of several webs to the processing station theoretically in like increments. Slippage or stretching of one web, however, will alter the feed-increment of one web relative to another. Upon stopping the roller, at least one web will then be misaligned with the processing station.

Independently feeding each of several webs to a common processing station also has been proposed as, for example, in U.S. Pat. No. 2,947,345. This arrangement is primarily intended to permit each web to be advanced at an independent rate but for substantially the same time so that different increments of each web may be fed to the processing station.

The patented arrangement further attempted to achieve more precise alignment of each web with the processing station by associating a photoelectric device with each web. The photoelectric devices detected marks placed along each web at increments corresponding to the increments at which the webs were to be aligned with the processing station. Upon detecting a mark, each photoelectric device sent a signal to a clutch-brake in the web-feeding means for that web to stop the web.

Such clutch-brakes, however, are mechanically incapable of the rapid, accurate starting and stopping necessary to produce precise registrations at economically desirable high web-feeding speeds. Backlash and other mechanical limitations of the apparatus as well as slippage and stretching of one web relative to another or even web breakage during its sudden stop makes impossible precise and rapid registration of each web with the processing station with such an arrangement.

A practical commercial apparatus which overcomes the problems associated with rapidly feeding a web and then indexing a portion of the web with a processing station, is disclosed in Bala U.S. application Ser. No. 481,918, now U.S. Pat. No. 3,948,425 filed June 21, 1974, and owned by the instant assignee. In the Bala apparatus, a variable speed servo-motor responds to an input voltage of preselected wave form to drive the nip rollers at speeds related to the instantaneous voltage amplitude. An encoder driven by the motor in conjunction with the web-feeding rollers generates pulses as the motor rotates so that the total number of pulses generated by the encoder is indicative of the length of the increment of web fed to the processing station.

A pulse counter counts the number of pulses generated by the encoder while the motor accelerates to and runs at full speed to rapidly feed most of the desired web-increment to the processing station. The counter then produces a signal which actuates control circuitry to cause the motor and thus the web to decelerate, the encoder generating a second group of pulses while the web decelerates. These latter pulses are used to develop a continuously decreasing analog voltage which in turn decelerates the motor. When the total number of pulses counted by the web control circuitry during the first web-accelerating and rapid-feeding stage and the second, deceleration stage reaches a preset number (which number corresponds to the length of increment of the web to be fed to the processing station), the motor, and the web, have come to a stop.

The apparatus of the Bala application is a significant advance over prior web handling devices, but while capable of feeding parallel webs simultaneously, it is not specifically adapted to maintain separate simultaneously fed webs in precise registry, where the webs are susceptible to misalignment because of stretching, supply variations, etc.

SUMMARY OF THE INVENTION

The present invention provides a novel web handling system in which the drawbacks of prior art systems are avoided. Incorporated in the applicant's novel system is an electronic web control arrangement for controlling means such as a servo motor operatively connected to web-feeding rollers for advancing each web. Web registration means in the system then enable extremely accurate, incremental advance of one or more webs into registry with a processing station. In a preferred embodiment for accurately and substantially simultaneously registering more than one separately fed web with the processing station, independent web registration means are associated with each web for precisely registering a desired portion of each web with the processing station.

Each web has index marks along its length at increments corresponding to those at which it is desired to register the web with the processing station. The web control and registration means include first and second index mark detecting means disposed along one web path and spaced from each other in the direction of web advancing movement, the second detecting means being closer to the processing station and at a distance therefrom such that when an index mark is detected by the second means, the proper portion of the web is in registry with the processing station.

In the multiple web feeding mode of operation, several webs or stacks of superimposed webs are individually advanced to the processing station along parallel paths by means associated with each web or stack of webs. The advancing means in each path preferably comprise a pair of web feeding rollers driven by a clutch-brake, all of the clutch-brakes being driven by a common motor. An operative first index mark detecting means is disposed along only one of the web paths for controlling operation of the motor, while each clutch-brake is individually controlled by separate second index mark detecting means disposed along its associated web path. As will be readily understood, first index mark detecting means may actually be disposed along each web path and connected together in a parallel-type circuit arrangement such that only the first of the detecting means to detect an index mark is operative to control the motor, the others serving as back-up units in case of some detection failure.

In accordance with the invention, the motor is energized to drive all of the roller pairs to advance the web (or webs) to the processing station at an economically desirable, high rate of speed until the portion of the web to be subjected to the processing step nears the processing station. The operative first index mark detecting means then detects an index mark to initiate deceleration of the motor. The deceleration of the motor is preprogrammed, as by an electrical ramp signal generator, so that the portion of the web to be processed would advance somewhat beyond the processing station before the motor stops, if not otherwise halted.

With the web advance slowing down, the index marks on the web or webs are then detected by the second detection means in each path to actuate its respective clutch-brake to accurately stop each web in proper registration with the processing station. Since each web or stack of webs is independently stopped by the one of the clutch-brakes in response to detection of its own index mark by its second detecting means, each of multiple webs or stacks of webs comes into precise registration with the processing station. Since each web is decelerating as it approaches registration with the processing station, the reduced speed of each web is sufficiently slow to permit the respective clutch-brakes to stop its associated web in accurate registration with the processing station, in spite of the mechanical limitation of the clutch-brakes and the fragility of the webs. Moreover, the independent control feature of the invention avoids the possibility of cumulative error.

Although of particularly notable advantage when employed with multiple webs, the system of the invention operates with single webs at speeds and with accuracy approaching that of the Bala electronically controlled system, while still relying on clutch-brake assemblies to provide the highly desirable multi-web capability. It thus distinguishes from the Bala system which has no capability for individual control of multiple webs, as well as earlier electromechanical systems, such as described in U.S. Pat. No. 2,947,345, that cannot achieve the speeds and precision of the present invention.

As will be appreciated, the index marks on the webs may be incorporated in preprinting placed on the web for other reasons. For example, the index marks may be part of a lable applied to each increment of the web to be registered with the processing station. Precise registration of such webs is particularly important to properly position the printing on each increment of the web at the processing station. Thus, the system described herein is particularly well adapted to preprinted webs in which a portion of the printing forms the index marks and which particularly requires the precise registration achieved with the invention.

DESCRIPTION OF THE DRAWINGS

The foregoing and other objects, features and advantages of the invention will become more apparent from the following detailed description of a preferred embodiment thereof, taken in conjunction with the accompanying drawings, in which.

DESCRIPTION OF THE PREFERRED EMBODIMENT

General

Figure 1:
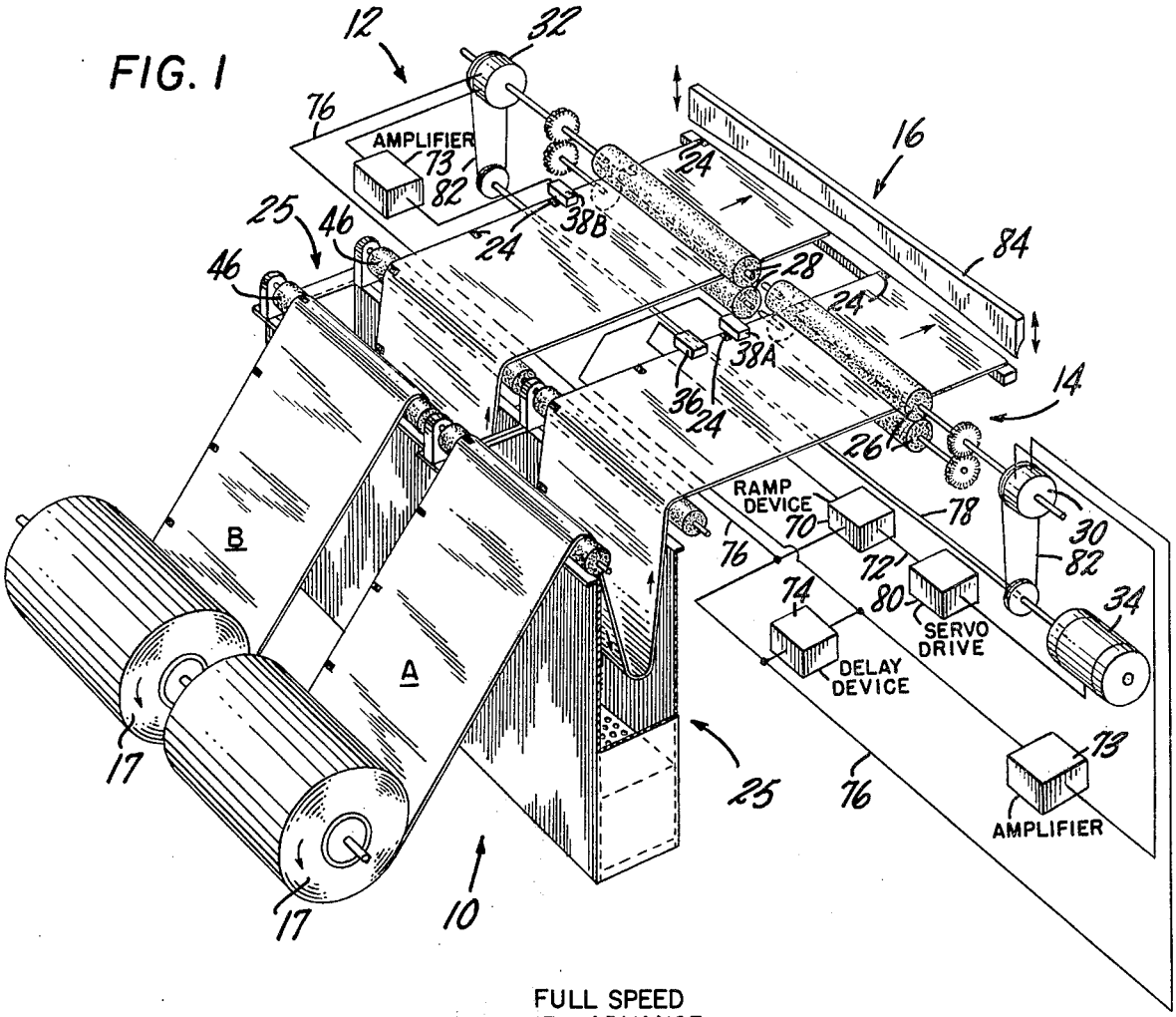
FIG. 1 is an overall electrical and mechanical schematic of the web handling system of the invention.

The overall web handling system illustrated in FIG. 1 is made up of four units: web supply and tension control means at 10, web control and registration means at 12; web advancing means at 14, and a processing station at 16. Two webs A, B are shown in the system, it being understood that the number of webs may be one or more with the system having particular utility with multiple webs.

The webs may be unwound from supply rolls 17 as shown or, in other embodiments, may be unfolded from an accordian-style supply bin (not shown) or may advance from an in-line source (not shown) such as an extrusion system which processes raw materials to produce film webs. Each web A, B has index marks 24 along one side of the web at intervals corresponding to the intervals at which portions of the web to be registered with the processing station at 16.

Each web A, B is advanced from the supply rolls 17 past tension control means 25 and the web control and registration means at 12 to the processing station at 16 by pairs of web-feeding nip rollers 26, 28, one pair being associated with each web. Each pair of the rollers 26, 28 is independently rotated for advancing the associated web by a clutch-brake 30, 32 respectively connected to the pairs of rollers. Both of the clutch-brakes 30, 32 are operatively connected to one servo motor 34 which then drives both pairs of rollers.

The web control and registration means at 12 comprise first means 36 for detecting the index marks on only one of the webs, web A as shown in FIG. 1. A second index mark detecting means 38A is spaced along web A from the first index mark detecting means 36 in the direction of web advance toward the processing station. A similar second index mark detecting means 38B is correspondingly positioned along web B for detecting index marks on that web. Each of the second index mark detecting means 38A, 38B is also positioned in alignment with and at a distance from the processing station such that detection of an index mark by the means 38A, 38B will, as later described, precisely register the desired portion of the web with the processing station.

GENERAL DESCRIPTION OF OPERATION

Each clutch-brake 30, 32 first operatively connects the web-feeding rollers 26, 28 to the motor 34 which generally operates to advance the webs A, B toward the processing station. Detection of an index mark by the first index mark detecting means 36 then indicates that desired portions of the webs to be registered with the processing station are approaching the processing station. The detecting means 36 then triggers a signal to the motor 34 which progressively decelerates the motor at a preprogrammed rate which, if uninterrupted, would advance the desired portions of the webs slightly beyond registration with the processing station. The indexing marks then progressively more slowly advance to the second index mark detecting means 38A, 38B. Upon detection of an index mark by these second means, each triggers a signal to disengage the clutch and apply the brake of the clutch-brake 30, 32 associated with the same web as the second index mark detecting means triggering the signal. Since the web is then moving slowly, the brake of the clutch-brake is effective to stop the associated web substantially immediately with the desired portion of the web precisely registered with the processing station. The brakes remain applied for a time sufficient to permit each web to be registered with the processing station and to perform the operation of the processing station and then are released with the coincident engagement of the clutches and starting of the motor 34 to again rapidly advance the webs toward the processing station.

MORE DETAILED DESCRIPTION

Figure 2:
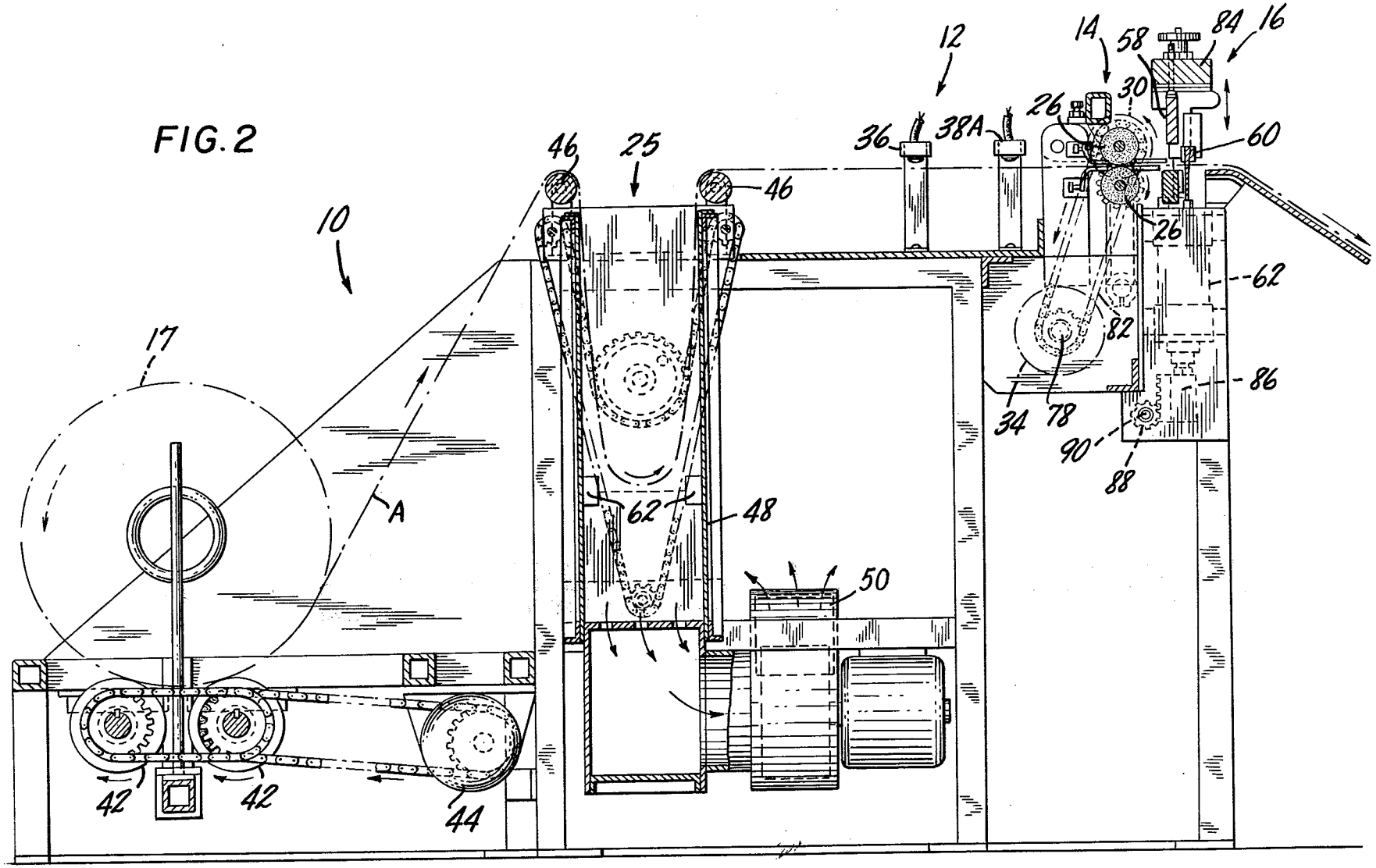
FIG. 2 is a more detailed side elevation of the system shown in FIG. 1.

FIG. 2 shows further detail of the apparatus of the system. This apparatus generally corresponds to the Web Handling Apparatus described in the above-mentioned copending U.S. patent application Ser. No. 481,918 now U.S. Pat. No. 3,948,425 of John L. Bala. As also described in this copending application, the web, for example A, is fed from its roll 17 to tension control means at 25 by roll-driving rollers 42 turned by a motor 44. The tension control means 25 have idler rollers 46 along opposite edges of an open side of a generally box-like housing 48 for handling the web as it advances through the tension control means. A suction device 50 is connected to the housing at an end remote from the open end and idler rollers 46 to apply a suction which draws the web into the housing to form a supply loop. The web is then advanced from the supply loop to the processing station by the web-feeding rollers 26. The processing station at 16, again as further described in the Bala application, comprises a heat sealing bar 58 and cutting knife 60 cooperatively moved against the web by piston and cylinder devices 62 (only one shown) at each end of the processing station. However, the Bala application discloses an all electronic web-indexing control with digital feedback which is operative without the index marks and detecting means of this system.

WEB SUPPLY AND TENSION CONTROL MEANS

In the apparatus shown in FIG. 2, the tension control means 25 is seen to additionally comprise a detector 62 having units positioned on opposite sides of the housing 48 for detecting the presence of the web supply loop at that portion of the housing. In the preferred embodiment, the detector 62 is a commercially available air jet diaphragm switch such as a Model 2500 Pneumaid Jet Sensor with Model 1000E Booster Assembly made by Industrial Hydraulic Corp. In this detector a jet of air passing between the units of the detector is interrupted by the web to trigger a signal. However, in other embodiments (not shown), the detector 62 may be a photoelectric switch or mechanical limit switch, the particular type of detector best suited for the apparatus depending on such factors as the thickness of the film, its opacity, and its stiffness.

As also described in the above referenced Bala application, the signal from the detector 62 performs two functions. A first function of the signal changes the speed of the motor 44 and thus the supply of web from the roll 17 to the tension control means to prevent an oversupply of the web.

A second function of the signal from the detector 62 is to close means (not shown) such as a relay switch in series with a power supply or later described control line 72 to the web advancing motor 34 to permit operation of the motor when other, later described conditions are also satisfied. By permitting operation of the web advancing motor 34 only when a preselected length of web has been drawn into the housing 48 by the vacuum device 50, the tension control assures a uniform tension on each increment of web advanced to the processing station. The web uniformly responds to the uniform tension, which is preferably present to prevent stretching or bunching of the web, to maintain a uniform spacing between the index marks on the web. The second index mark detecting means 38A, and the corresponding means 38B for the web B, will then precisely register the desired portion of each web with the processing station. Although the tension control means described thus desirably and uniquely cooperates with the web control and registration means, it will be understood that other tension control means or, for inelastic webs, no tension control means may be used in other embodiments.

WEB CONTROL AND REGISTRATION MEANS

The index mark detecting means 36, 38A and 38B may each be a commercially available photoelectric device having a light source reflecting light from the web to a photocell to trigger a signal from the photocell with the contrast between the light reflected from the web between index marks and the light reflected from the index marks.

As shown in FIG. 1, the first index mark detecting means 36 is connected to a reversible ramp signal generator 70 which responds to the index mark detection signal from the first index mark detecting means with a signal to the motor 34 over line 72 which progressively decelerates the motor at a rate which will advance the web from the position with an index mark detected by the detecting means 36 to a position with the desired portion of the web advanced somewhat beyond its desired position of registration with the processing station before the motor stops. This overshoot of the motor is selected to be long enough to assure that each web will advance into registration with the processing station, but short enough to substantially stop the motor before the processing station finishes its operation and the motor must again rapidly advance the web.

The second index mark detecting means 38A associated with the web A is connected through amplifier 73 to a terminal of the clutch-brake 30 which responds to the index mark detection signal from detecting means 38A by disengaging the clutch and applying the brake to stop the connected nip rollers 26. The detecting means 38B is similarly connected to clutch-brake 32.

In the embodiment illustrated in FIG. 1, the second index mark detecting means 38A is also connected to a commercially available time delay device 74 which, after a preselected time delay, responds to the signal from the index mark detecting means 38A with a signal to the ramp signal generator 70 which causes the ramp generator to provide a signal over the line 72 to the motor 34 which accelerates the motor to its full operating speed for rapidly advancing the web toward the processing station. The signal from the delay device 74 is also carried over lines 76 to a terminal on each of the clutch-brake devices 30, 32 for releasing the brakes and engaging the clutches for again operatively connecting the nip rollers 26, 28 to the motor 34 for accelerating and rapidly advancing the web with the operation of the motor.

Figure 3:
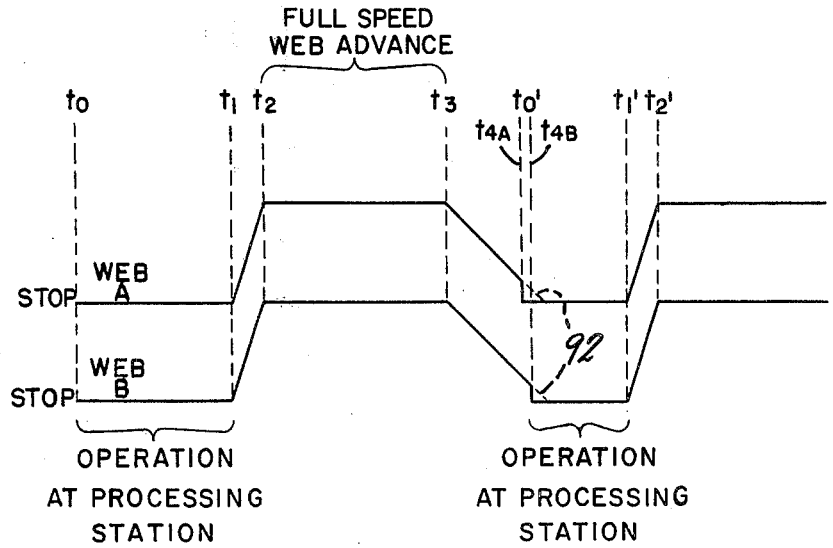
FIG. 3 is a diagram of the movement of the webs in the system shown in FIGS. 1 and 2.

Inasmuch as the motor and clutch-brakes simultaneously begin to accelerate and then rapidly advance the web, this movement of the web (later described with reference to the web movement between time $t_1$ and $t_3$ as shown in FIG. 3) may be produced by a corresponding signal from the ramp generator to a servo drive 80 for the motor 34 in line 72. It is known to produce such a signal with an integrating circuit with a clamped maximum output just as also described in the above-mentioned Bala application.

Decelerating the webs before stopping them in registry with the processing station then requires a signal from ramp device 70 over line 72 to servo drive 80 generally corresponding to the web movement shown between time $t_3$ and $t_1'$ in FIG. 3 (ignoring the time difference between $t_{4A}$ and $t_{4B}$ at $t_0'$ which is later described). Recalling that this signal is produced by the ramp signal generating device 70 in response to a signal from detecting means 36, whereas the web-accelerating and rapid-advancing signal is produced by the ramp device in response to the signal from delay device 74 over separate line 76, it is readily understood how these signals on separate lines may switch the ramp device from motor-accelerating to motor-decelerating output signals.

One way of producing the decreasing signal for decelerating the web would be to connect a commercially available digital encoder (not shown) to the shaft 78 from motor 34. Rotation of the motor shaft would then provide a train of pulses which could be applied to a commercially available pulse counter the output of which goes to a digital to analog converter (neither shown) in the ramp device 70. The signal from device 36 would enable the digital to analog converter to produce an output signal. The signal could also reset the counter to a preselected number (if it were not otherwise reset as described in the Bala application) so that the counter decrements for each pulse from the encoder and the converter produces a correspondingly decreasing signal reaching a fixed level (corresponding to the stopped web between time $t_0$ and $t_1$ in FIG. 3) when the counter reaches 0. Selecting the initial count in the counter thus determines the interval over which the web could decelerate (from $t_3$ to $t_0'$ plus the increments 92 later described with reference to FIG. 3).

The decreasing signal from the digital to analog converter may be amplified by an amplifier which is connected, in parallel with the integrating acceleration ramp generator, to line 72. However, only one of the integrating ramp and amplifier may produce a signal at any one time if each is enabled to produce its output by a signal from opposite state terminals of a commercially available flip-flop (not shown). The flip-flop may be connected to the device 36 to respond to its signal with a signal at the terminal connected to the amplifier to enable is output and to respond to the signal on separate line 76 to change state to provide a signal to the integrating ramp to enable its output, and, of course, disable the amplifier.

All these readily understood devices will now be recognized as corresponding to similarly described devices in the Bala application. It will be understood that, although the inventor prefers this mode at least because his familiarlity with the disclosure of the Bala application made this the best mode for him to contemplate to carry out his invention, others may readily conceive of more direct ways of producing the reversible ramp signal generator 70 just described in detail. Such alternatives are intended to be within the scope of the invention.

An alternative embodiment (not shown) may include additional web advancing operations disclosed in the above referenced Bala application such as the brief reverse feeding of the web prior to advancing the web for separating the web from the heat sealing bar 58 (FIG. 2). This embodiment can be incorporated in the above referenced Bala application disclosure with a minimum of modification. Those features of the Bala controls that relate to the drive for the web supply rolls 42, for example, and to the controls for the process station 16, as described in the Bala application, do not form a part of the inventive subject matter according to this invention, but are compatible with the inventive web control features described here and are incorporated into this specification by reference.

Whereas Bala uses a digital encoder coupled with the web feed roll shaft and associated digital circuitry to control his apparatus in dependence on shaft rotation, the signal from the photocells in the instant arrangement (amplified or reshaped if necessary) can provide like control of the process station 16. The ramp generator or ramp device described herein can be the photocell activatible combination of a multivibrator and a known reversible ramp forming circuit, from which a voltage increasing and then a voltage decreasing ramp can be delivered. In this case the multivibrator and ramp circuit can replace Bala's digital circuitry in its entirety. Alternatively, by appropriate switch connections, the circuitry according to this invention can be employed in addition to Bala's digital control to thereby provide alternative modes of operation.

WEB ADVANCING MEANS

The motor 34 is a DC electric motor of a type commonly used in servo systems. The motor is operated by associated servo control 80, both the motor and servo control being commercially available as, for example, a model A-150 motor and a model 45HL-S601R servo control both made by Hyper-Loop, Inc. The motor turns the output shaft 78 which is operatively connected by belt and wheel means 82 to each of the clutch-brakes 30, 32. Suitable clutch-brakes are commercially available from the Warner Electric Corporation.

THE PROCESSING STATION

The processing station shown in FIG. 1 has a guillotine-like action in which a movable beam 84 is raised from the webs while the webs advance into registration with the processing station and, when the webs have stopped in registration, moves toward the webs to perform a desired function. As shown in FIG. 2 the beam 84 carries the heat sealing bar 58 for sealing the webs A, B when they are a stack of superimposed webs and the cutting knife 60 for cutting the webs. The beam is supported and moved by the piston and cylinder means 62 which are connected to each end of the beam and to racks 86 (only one shown) engaged with pinions 88 (only one shown) which are connected to a common shaft 90 for assuring coordinate movement of each end of the beam. In other embodiments, the processing station may be comprised, of course, of other or additional equipment.

As also described in the above reference Bala application, the processing station may additionally include a switch (not shown) forming an index trip gate which provides a signal indicating completion of the operation of the processing station as by movement of the beam away from the web. In this embodiment, the index trip gate would replace the delay device 74 which, as before described, initiates a motor accelerating and operating signal from the ramp device 70.

OPERATION

FIG. 3 is a diagram of the movement of the webs A, B from the web control and registration means at 12 through the web advancing means at 14 to the processing station at 16 shown in FIGS. 1 and 2. From an initial time $t_0$ to a time $t_1$ which represents the delay time of delay device 74, both webs A, B are stopped. At the time $t_1$, the delay device 74 provides the signal to the ramp device 70 and, over lines 76, to the clutch-brakes 30, 32. The signal to the ramp device 70 initiates the signal over the line 72 to the servo control 80 for the motor 34 which accelerates the motor to its full speed and then maintains its full speed operation. The signal over the lines 76 simultaneously releases the brakes and engages the clutches of the clutch-brakes 30, 32 to operatively connect the web advancing nip rollers 26, 28 to the motor for advancing the webs A, B at an economically desirably high rate. The acceleration of the webs is indicated in FIG. 3 between the times $t_1$ and $t_2$ followed by the steady rapid advance of the webs between times $t_2$ and $t_3$.

The time $t_3$ is determined by the detection of an index mark by the first index mark detecting means 36. The signal from the detecting means 36 to the ramp device 70 then initiates the signal over the path 72 to the servo control 80 and motor 34 which decelerates the motor and thereby decelerates the advancing movement of the webs A, B.

Web A then decelerates as it advances the index mark just detected by the first index mark detecting means 36 to the second index mark detecting means 38A. Detection of the index mark by the second index mark detecting means 38A indicates precise registration of the desired portion of web A with the processing station 16 and the signal triggered by the detection of the index mark is then immediately effective at the connected terminal of the clutch-brake 30 to disengage the clutch and apply the brake to stop immediately web A in its position of precise registration with the processing station. This stopping of web A is indicated by the abrupt, substantially instantaneous stopping of its movement at time $t_{4A}$ in FIG. 3. The relatively slow, decelerated movement of the web at time $t_{4A}$ permits the web to be so abruptly stopped without stretching or tearing of the web, it being understood that any time delay inherent in the operation of the clutch brakes may be compensated for by positioning the second index mark detection means slightly upstream relative to the direction of web travel of the position at which detection of an index mark precisely registers the desired portion of the web with the processing station.

In ideal operation of the apparatus, web B would now also have advanced to a position in precise registration with the processing station. However, the difficulty of threading multiple webs into the apparatus with precise alignment of their index marks, slippage or variation of the diameters of the web advancing nip rollers 26, 28, or even stretching of one of the webs often causes some misalignment of the index marks between the webs. Precisely registering the desired portion of web A with the processing station will then not assure precise registration of a desired portion of web B with the processing station.

This problem is overcome by the second index mark detecting means 38B and its independent control of the clutch brake 32. As shown in FIG. 3, web B continues to advance toward the processing station until a somewhat later time $t_{4B}$ at which the second index mark detecting means 38B detects an index mark to immediately disengage the clutch and apply the brake of the connected clutch brake 32 thereby immediately stopping web B in the desired position of precise registration with the processing station.

Although the time $t_{4B}$ is shown in FIG. 3 to be somewhat after the time $t_{4A}$ at which web A is stopped, it will be understood that the relative sequence of times $t_{4A}$ and $t_{4B}$ may be interchanged or even be simultaneous within the inventive concept of independently and precisely registering one or more webs with the processing station. The deceleration of the motor 34 for a time somewhat greater than that required for precisely registering each of the webs with the processing station is indicated by the phantom continuation of the web deceleration at 92 in FIG. 3.

The signal from one of the second index mark detecting means, means 38A in FIG. 1, is also provided to the delay device 74 to initiate the period of time delay for the operation at the processing station while the web is stopped from time $t_0$ to $t_1$, $t_0'$ to $t_1'$, etc. before again advancing the web in a next cycle starting at time $t_0$, $t_0'$, etc. Time $t_0'$ then corresponds to the time $t_{4A}$ as shown in FIG. 3.

It is to be understood that many modifications of apparatus disclosed herein will become apparent to those skilled in the art from this disclosure of the invention. Therefore, it is intended that the invention be limited only as set forth in the claims.

I claim:

1. A system for handling a first web and at least one further web to register preselected portions of the webs at increments with a processing station, the system comprising:

means for advancing said first web to said processing station; web control means for detecting the approach of a preselected web portion of said first web to the processing station; means responsive to the means for detecting the approach for slowing the web advance of the first web; registration means for detecting the registration of said preselected web portion with the processing station; and means responsive to the means for detecting said registration for stopping the slowed first web;

said means for advancing said first web also comprising means for advancing said further web; said means for detecting the approach of said web portion being operatively associated with only said first web for jointly slowing both said first and further webs but said registration detecting means and said responsive means being associated with both said first and further webs for independently stopping said webs, said registration detecting means including first and second independently operable means for detecting registration of preselected web portions of both said first and further webs, respectively, with said processing station, and said responsive means for stopping said webs including first and second independently activatible means for stopping each of said first and further webs, respectively, in response to the respective means for detecting registration, whereby exact registration of each web for processing by the processing station occurs despite relative misalignment of the first and further webs.

2. The web-handling system according to claim 1 wherein the webs have index marks at increments corresponding to those at which portions of the webs are registered with said processing station, and wherein said means for detecting the approach of said web portions to said processing station, which is associated only with one of said webs, comprise first index mark detecting means, but said registration detecting means, which are associated with both webs, comprise second index mark detecting means, said second index mark detecting means being associated, respectively, with said first-mentioned and said further webs.

3. The web-handling system according to claim 2 wherein said first and second index mark detecting means are photoelectric devices.

4. The web-handling system according to claim 2 wherein said means for independently stopping each of said webs is a clutch-brake operatively and independently connecting said means for advancing said webs to one motor.

5. The web-handling system according to claim 2 wherein said means for slowing the advance of said webs comprises a ramp signal generator.

6. The web-handling system according to claim 5 wherein said ramp signal generator is preprogrammed for decelerating said means for advancing said webs at a rate which would, if uninterrupted, advance said portions of each web past said positions of registration with said processing station before said advancing means stops, and said means for stopping said webs comprises means for interrupting said deceleration of said webs.

7. The web-handling system according to claim 2 additionally comprising time delay means responsive to detection of an index mark by one of said second index mark detecting means for maintaining said web advancing means in a stopped condition for a predetermined time, whereby said processing station completes its operation on stopped webs.

8. A system for handling webs, each web having index marks at increments corresponding to increments at which it is desired to register portions of each web with a processing station, the system comprising: a pair of web-feeding rollers for advancing each web to the processing station; a motor; clutch-brakes operatively connecting each pair of web feeding rollers to said motor; web control means associated with one web and having first means for detecting an index mark and a ramp signal generator connected to said motor and responsive to detection of an index mark by said first detecting means with said ramp signal for decelerating said motor; and web registration means associated with each web and each having second means aligned with each other, one being spaced from said first detecting means along said one web in the direction of web advance, for detecting an index mark on each web, each second detecting means being connected to said clutch-brake associated with the same web for independently stopping said operatively connected pair of web-feeding rollers upon detection of an index mark by said second detecting means whereby said portion of each web is registered with said processing station.

9. A method of web handling including the steps of a. moving a first web along a predetermined path of travel, b. moving a second web along a predetermined path of travel, c. detecting the approach to a web processing station of a preselected web portion of the first web, d. decelerating both of the first and second webs upon said step of detecting the approach of only the preselected web portion of the first web, e. stopping the decelerating first web with said preselected portion in registration with the web processing station, f. stopping the decelerating second web with a preselected portion of said web in registration with the web processing station independently of the step of stopping the first web, whereby both said first and second webs are accurately aligned with said station despite relative misalignment of the first and second webs prior to stoppage, the webs to simultaneously processed at said station.

10. A method according to claim 9 wherein said step of decelerating both said first and second webs comprises decelerating both said webs towards a stopping point at which both said preselected portions of said webs would be past said registration with said processing station, said steps of stopping said webs interrupting said decelerating when the webs are registered with said processing station.

11. A method according to claim 9 wherein said step of detecting the approach of said first web to said processing station comprises detecting an index mark on said first web.

12. A method according to claim 9 wherein said steps of stopping the decelerating of said webs comprises independently detecting an index mark on each web and independently stopping each web in response to said detecting.

* * * * *

UNITED STATES PATENT OFFICE

CERTIFICATE OF CORRECTION

Patent No. 4,011,975 Dated March 15, 1977

Inventor(s) Fred P. Brown, Jr.

It is certified that error appears in the above-identified patent and that said Letters Patent are hereby corrected as shown below:

Col. 8, Line 37, change "is" to --its--;
Col. 9, Line 47, change "reference" to --referenced--;
Col. 12, Line 68, after "to " insert --be--.

Signed and Sealed this

*Eighteenth* Day of *October 1977*

[SEAL]

*Attest:*

RUTH C. MASON
*Attesting Officer*

LUTRELLE F. PARKER
*Acting Commissioner of Patents and Trademarks*